US005462093A

United States Patent [19]

Froment

[11] Patent Number: 5,462,093

[45] Date of Patent: Oct. 31, 1995

[54] DAMPER DEVICE FOR WEAVING MACHINE OSCILLATING MEMBERS

[75] Inventor: Jean-Paul Froment, Doussard, France

[73] Assignee: S.A. des Etablissements Staubli (FRANCE), Faverges, France

[21] Appl. No.: 251,257

[22] Filed: May 31, 1994

[30] Foreign Application Priority Data

Jun. 3, 1993 [FR] France ..... 93 06882

[51] Int. Cl.[6] ..... D03C 9/00

[52] U.S. Cl. ..... 139/57; 74/105; 267/150

[58] Field of Search ..... 139/57, 58; 74/519, 74/105; 267/150

[56] References Cited

U.S. PATENT DOCUMENTS

| | | | |
|---|---|---|---|
| 4,392,515 | 7/1983 | Moessinger | 139/57 |
| 4,460,020 | 7/1984 | Juillard | 139/57 |
| 5,016,581 | 5/1991 | Parsons | 74/519 |
| 5,195,385 | 3/1993 | Johnson | 74/105 |

FOREIGN PATENT DOCUMENTS

| | | | |
|---|---|---|---|
| 601281 | 1/1960 | Italy | 139/57 |
| 113529 | 12/1924 | Switzerland | 139/57 |
| 549668 | 5/1974 | Switzerland . | |

*Primary Examiner*—Andy Falik
*Attorney, Agent, or Firm*—Dowell & Dowell

[57] ABSTRACT

A motion damping system for a weaving machine which includes a pair of elastic members connected to supply damping force in opposite directions to an oscillating member. The oscillating member is connected to a control member so as to oscillate to and from a median position. The oppositely directed elastic members apply continous force to urge the oscillating member toward the median position.

13 Claims, 1 Drawing Sheet

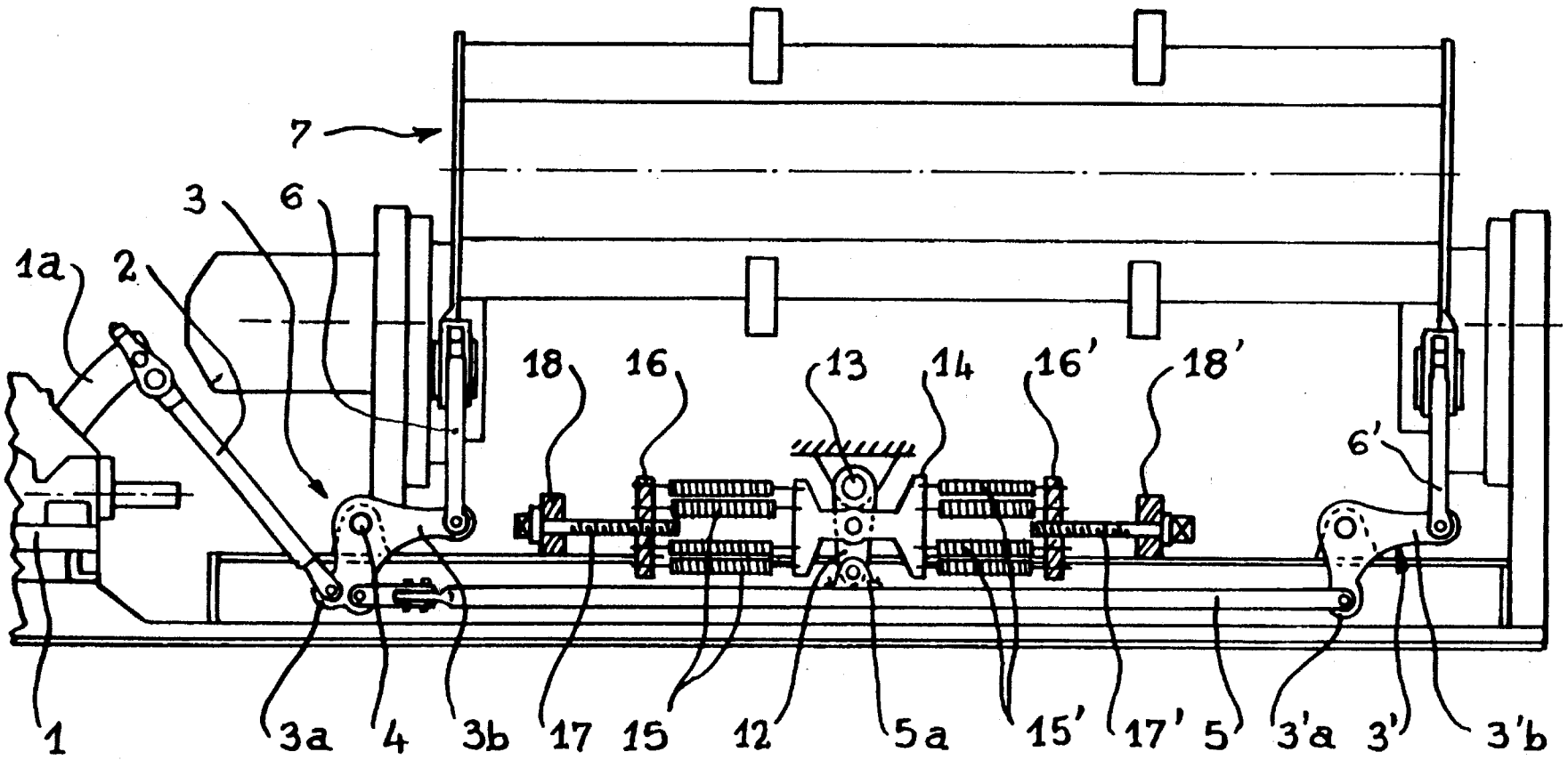
3'b
3'
3'a
6'
5'
18'
17'
16'
15'
14
5a
13
12
15
16
17
18
3b
4
3a
7
6
3
2
1a
1

DAMPER DEVICE FOR WEAVING MACHINE OSCILLATING MEMBERS

BACKGROUND OF THE INVENTION

FIELD OF THE INVENTION

The present invention relates to a damper system adapted to be associated with a weaving machine mechanism for selectively controlling a yarn or a group of yarns and which includes at least one member which is positively moved by a desmodromic oscillating movement.

HISTORY OF THE RELATED ART

It is known that the shed-forming devices in weaving machines are in the form of dobbies or Jacquard systems respectively comprising heddle frames and griffe frames driven by systems of the positive type. These members, provided with a reciprocating movement, present considerable masses, with the result that their displacement naturally requires a high consumption of energy and generates high kinetic energy. Under these conditions, at the moment of reversal of the movement, considerable forces are produced which bring about excessive wear and tear and create noise detrimental to the environment; these very high instantaneous forces ("peaks") obviously have repercussions on energy consumption.

The improvements forming the subject matter of the present invention aim at overcoming these drawbacks and at allowing general damping of the forces of inertia in the movement of a weaving machine mechanism.

SUMMARY OF THE INVENTION

The present invention is directed to a system for damping the motion of members which are connected to the yarns in a weaving machine which members move in an oscillating motion to manipulate said yarns during the weaving operation. In the embodiment disclosed, a heddle frame is moved by a linkage mechanism which is driven by a control apparatus which includes a reciprocating arm which is connected to a pair of spaced levers which are interconnected by a connecting bar. The levers are also connected by rods to the heddle frame which is the member which is movable with an oscillating motion. As the member is oscillated, it moves toward and away from a median position at which the direction of motion is reversed. The damping system of the invention provides a pair of oppositely directed elastic elements which are connected relative to the heddle frame in such a manner as to continuously urge the member toward the median position.

In the preferred embodiment, the oppositely directed elastic means may be adjusted in tension so as to adjust the movement of the heddle frame relative to the medium position.

In the preferred embodiment, the resilient elements are mounted on either side of a pivotable rod which is connected to the connecting bar. Each elastic member is mounted at one end to a traveling lug which is threadingly engaged with an adjustment screw which is deposed through a fixed block. By adjusting the screws, the elastic elements may be placed into greater tension with respect to one another to thereby adjust the damping force applied through the linkage mechanism to the heddle frame.

It is a primary object of the present invention to provide a motion damping system for the use in weaving looms which include at least one movable member which is moved by a control member in an oscillating motion toward and away from a medium position to thereby reduce the amount of force necessary to cause the reversal in movement of the movable member such as a heddle frame.

BRIEF DESCRIPTION OF THE DRAWINGS

The invention will be more readily understood on reading the following description with reference to the accompanying drawing, in which:

The single FIGURE is a simplified, general view of a dobby comprising a damping system in accordance with the invention.

DESCRIPTION OF PREFERRED EMBODIMENT

Referring now to the drawings, the single Figure illustrates the application of the invention to a mechanism for weaving machine constituted by a dobby.

The dobby comprises in known manner a control assembly 1 which includes an arm 1*a* a reciprocating oscillating movement. The free end of arm 1*a* which is movable in a connecting rod 2 which is pivotally connected to the end of a first arm 3*a* of a lever 3 mounted to pivot with respect to a fixed horizontal axis 4. At the same end of the arm 3*a* of the lever 3 there is articulated a connecting bar 5 which is attached to an arm 3'*a* of another lever 3' identical to lever 3. The horizontal arms 3*b*, 3'*b* of the levers 3 and 3' are each attached a vertical rod 6, 6' connected to the two sides of a heddle frame 7, in manner well known in the art, and it is therefore unnecessary to describe this arrangement in greater detail.

It will be recalled that rocking of the arm 1*a* causes the frame 7 to be displaced vertically in a reciprocating manner.

According to the invention, the connecting bar 5 comprises a forked bracket 5*a* which cooperates with a small rod 12 oscillating about a fixed pin 13. A plate 14 in the form of a double T is pivoted on the rod 12. To each of the outer ends of the latter there is hooked a series of springs 15, 15' which are also hooked to a lugs 16, 16", respectively. Each of these latter cooperates with an adjusting screw 17, 17' rotating freely in a fixed block ear 18, 18'.

If lugs 16, 16' lie at an equal distance from pin 13, the springs 15 and 15' exert a return force which tends to return the small rod 12, and consequently rod 5 and frame 7, into a substantially median position as shown in the drawing figure.

It will be readily understood that the displacement of the bar 5 in one direction or in the other stretches one series of springs and relaxes the other.

If, symmetrically, lugs 16, 16' are displaced in the direction opposite small rod 12, the springs may be stretched more so as to increase their reaction. Springs 15 associated with lug 16 may be stretched to a greater extent than springs 15' associated with lug 16', or vice versa, so that the connecting bar 5 is returned into a position somewhat different from its position of static equilibrium and the intensity of the return forces is different for one direction of displacement than the other.

A damping system has thus been produced which reduces in particular the peaks of the forces caused by the masses in movement of a member such as the heddle frame at the moment of the reversals of its direction of motion relative to the medium position of the member. In this way, elastically balanced oscillating members may be produced, thus avoiding considerable forces during reversals of directions of movement and thus reducing the energy consumed.

It goes without saying that the system according to the invention may be applied to any oscillating member of a mechanism for a textile machine, such as for example the sleys or reeds of a loom which cooperate with the warp and weft yarns to tighten the picks against one another, or the weft thrower in a shuttle-less loom. Furthermore, the helicoidal springs 15 and 15' may be replaced by any other elastically deformable members, particularly by flat blades.

What is claimed is:

1. A motion damping system for use in a weaving machine having at least one movable member which is continuously moved in an oscillating motion to and from a median position to manipulate yarn being woven and which motion is controlled by a control means connected to the movable member to impart the oscillating motion thereto, the damping system comprising, a pair of opposing elastic means, and means for connecting said pair of elastic means to the movable member to apply oppositely directed force thereto to continuously urge the movable member toward the median position.

2. The damping system of claim 1 including a pair of adjusting means, said adjusting means being connected to said elastic means whereby the relative force of said elastic means relative to said movable member may be selectively adjusted.

3. The damping system of claim 2 in which said means for connecting includes a rod means adapted to be pivotally connected to the weaving machine, means for connecting a first end of each of said elastic means on opposite sides of said rod means, and means for connecting a second end of each of said elastic means to said adjusting means.

4. The damping system of claim 3 in which each of said adjusting means includes a screw threadingly engaging said means for connecting said second ends of said elastic means to said adjusting means, and each of said screws being mounted through a support block.

5. The motion damping system of claim 4 in which each of said elastic means includes a plurality of springs.

6. The motion damping system of claim 5 in which the control means includes a pair of rocking levers adapted to be pivotally mounted to the weaving machine and each having a first end connected to a connecting rod and second end connected to spaced rods which are connected to the movable member, and an oscillating arm connected to one of said rocking levers.

7. The damping system of claim 1 in which said means for connecting includes a shiftable means mounted between said elastic means, a first end of each of said elastic means being connected to said shiftable means, and means for connecting said shiftable means to the control means.

8. The motion damping system of claim 9 in which each of said elastic means includes a plurality of springs.

9. A motion damping system for use in a weaving machine having at least one heddle frame which is continuously moved in an oscillating motion to and from a median position to manipulate yarn being woven and which motion is controlled by a control means connected to said at least one heddle frame, the damping system comprising, a pair of opposing elastic means, and means for connecting said pair of elastic means to the heddle frame to apply oppositely directed force thereto to continuously urge the heddle frame toward the median position.

10. The damping system of claim 1 in which said means for connecting includes a shiftable means mounted between said elastic means, a first end of each of said elastic means being connected to said shiftable means, and means for connecting said shiftable means to the control means.

11. The damping system of claim 10 including a pair of spaced adjusting means, said adjusting means being connected to said pair of elastic means whereby the relative force of said pair of elastic means relative to said shiftable means may be selectively adjusted.

12. The motion damping system of claim 11 in which each of said elastic means includes a plurality of springs.

13. The motion damping system of claim 11 in which the control means includes a pair of rocking levers adapted to be pivotally mounted to the weaving machine and each having a first end connected to a connecting rod and second end connected to spaced rods which are adapted to be connected to the heddle frame, and an oscillating arm connected to one of said rocking levers and said shiftable means being connected to said connecting rod.

* * * * *